United States Patent [19]

Bridge et al.

[11] 4,004,324

[45] Jan. 25, 1977

[54] APPARATUS FOR PRODUCING FIBROUS WEBS

[75] Inventors: Frank Bridge, Bolton; Tej Kuldip Singh, Baildon, both of England

[73] Assignee: The Associated Paper Mills Limited, London, England

[22] Filed: Mar. 13, 1972

[21] Appl. No.: 234,098

Related U.S. Application Data

[63] Continuation-in-part of Ser. No. 842,889, July 18, 1969, abandoned.

[52] U.S. Cl. ..... 19/156.3; 19/156

[51] Int. Cl.[2] ..... D01G 25/00

[58] Field of Search ..... 19/155–156.3; 425/80–83; 156/62.2; 264/115, 121, 91

[56] References Cited

UNITED STATES PATENTS

| | | | |
|---|---|---|---|
| 2,230,270 | 2/1941 | Simpson | 19/156 X |
| 2,569,765 | 10/1951 | Kellett et al. | 19/156 UX |
| 2,581,069 | 1/1952 | Bertolet, Jr. | 19/156.1 |
| 2,698,271 | 12/1954 | Clark | 19/156.3 X |
| 2,711,381 | 6/1955 | Novonty et al. | 19/156.3 X |
| 2,993,239 | 7/1961 | Heritage | 19/156.3 |
| 3,032,836 | 5/1962 | Anderberg et al. | 19/156.3 |
| 3,071,822 | 1/1963 | Meiler | 19/156.3 |
| 3,252,186 | 5/1966 | Oja | 19/156.3 |
| 3,442,204 | 5/1969 | McCanless et al. | 19/156.4 X |
| 3,575,472 | 4/1971 | Brewster et al. | 19/156.4 X |
| 3,717,905 | 2/1973 | Furbeck | 19/156.3 X |

*Primary Examiner*—Dorsey Newton
*Attorney, Agent, or Firm*—Browne, Beveridge, DeGrandi & Kline

[57] ABSTRACT

The present invention relates to papermaking and particularly to a method of producing a fibrous web of uniform thickness and variable width which comprises feeding fibres from a supply zone which is in a fixed position and has a first lateral dimension into an expansion zone, permitting said fed fibres to fall through said expansion zone while moving laterally outwardly to form downwardly progressing zones of progressively decreasing fibre density, establishing a suction zone beneath said expansion zone said suction zone having a second lateral dimension which is variable and greater than said first lateral dimension and reducing the pressure in said suction zone to below the pressure in said expansion zone by an amount sufficient to form a web of fibres between said expansion and suction zones but insufficient to prevent said laterally outward movement of said fed fibres and forming a web of fibres between said expansion and suction zones which extends over the whole width of said second lateral dimension and apparatus for carrying out the above described method.

1 Claim, 10 Drawing Figures

Figure 1:
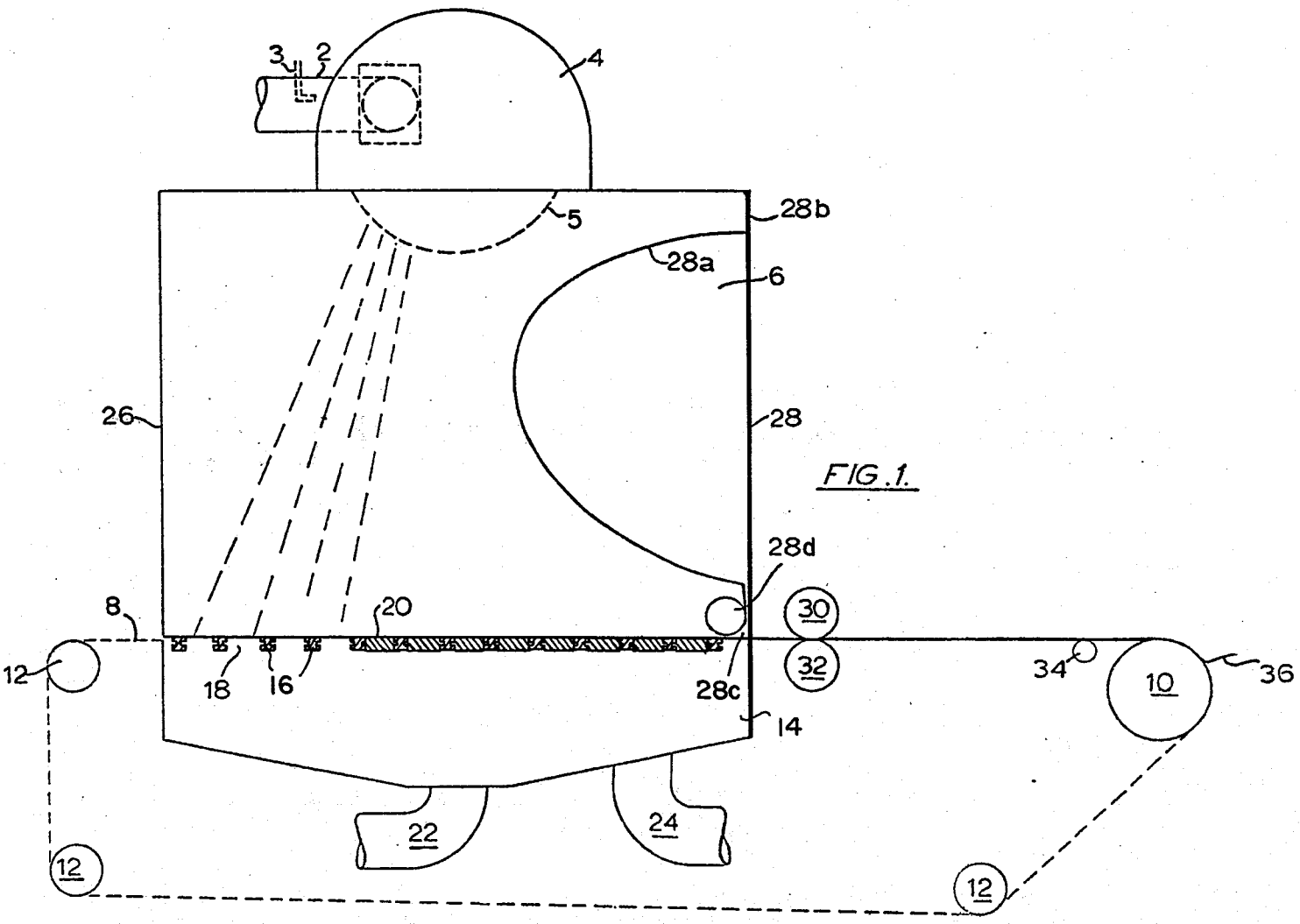

FIG. 1.

APPARATUS FOR PRODUCING FIBROUS WEBS

This is a continuation-in-part of our application Ser. No. 842,889 filed July 18, 1969, now abandoned.

The present invention relates to an improved method and apparatus for producing a fibrous web and the production of products therefrom.

The production of fibrous webs by deposition of fibres onto a foraminous screen has been practised for many years. The production of variable widths of web has hitherto been achieved by the use of a supply means which traverses a continuously moving screen. Problems arise in such arrangements however particularly with regard to the achievement of uniform thickness of web and other properties and further ancillary equipment is usually required e.g. for levelling the surface of the web.

It is an object of the present invention to provide a method and apparatus for producing a fibrous web by deposition of fibres in which uniform thickness of web is achieved without the use of traversing mechanisms but whilst retaining the facility of variability of the width of web produced.

According to one embodiment of the present invention a method of producing a fibrous web of uniform thickness and variable width is provided which comprises feeding fibres from a supply zone which is in a fixed position and has a first lateral dimension into an expansion zone, permitting said fed fibres to fall through said expansion zone whilst moving laterally outwardly to form downwardly progressing zones of progressively decreasing fibre density, establishing a suction zone beneath said expansion zone said suction zone having a second lateral dimension which is variable and greater than said first lateral dimension and reducing the pressure in said suction zone to below the pressure in said expansion zone by an amount sufficient to form a web of fibres between said expansion and suction zones but insufficient to prevent said laterally outward movement of said fed fibres and forming a web of fibres between said expansion and suction zones which extends over the whole width of said second lateral dimension.

The present invention also provides an apparatus for forming a fibrous web which comprises a foraminous fibre-receiving member; means defining an expansion chamber disposed above said fibre-receiving member; supply means for supplying fibres to and disposed in fixed geometrical relationship with said expansion chamber and initiating the passage of individual fibres downwardly and laterally through said expansion chamber in downwardly progressing zones of progressively decreasing fibre density to said fibre-receiving member to form a web of fibre thereon, and means for maintaining a pressure differential across said fibre-receiving member for holding the formed web on said fibre-receiving member while permitting lateral movement of the fibres during their downward passage through said expansion chamber and means for varying the lateral distance over which the said pressure differential is effective.

By ensuring that sideways movement of the fibres occurs during passage through the expansion chamber, the distribution of the fibres on the foraminous fibre-receiving member can be made substantially uniform. If the pressure differential were raised so as to prevent such lateral movement, an uneven distribution of fibres occurs on the receiving member and the resulting web has areas of low and high fibre density. The pressure differential required increases with the thickness of the resulting web. Thus for webs weighing 2000 to 3000 gms. per sq. metre, depending on the nature of the fibres and fillers or binders incorporated, the pressure differential can be up to 24 of water. For webs produced from wood pulp fibres and weighing 60 to 80 gms. per square meter excess of the pressure differential may be as low as 0.2 inches of water depending on the mixture and amount of fillers etc. used.

The fibres are preferably fed to the supply zone in a gaseous carrier medium such as air. In the remaining description air will be referred to as the carrier medium although other gases could be used if desired. Either the whole or only a portion of the air entering the supply zone may be passed through the expansion and suction zones depending on the size of the fibrous web required. For small webs the total volume of air required to act as carrier for the fibres can usually be passed through the expansion and suction zones but when large webs are required the total amount of air required to act as carrier for the fibre to the supply zone is in general too great to be passed through the expansion and suction zones without giving rise to difficulties such as the formation of a rippled surface on the web caused by the degree of suction required being too high to allow zones of decreasing fibre density to be properly formed. In either case a recirculatory system is preferably established whereby air is passed from an inlet point for fibres to the supply means and from the supply means to the inlet point for fibres either wholly or partially through the expansion and suction zones.

Thus in a preferred embodiment one of the fans provided for the suction box may be used to recirculate air to the supply zone via the fibre inlet, whilst the other fan removes excess air from the expansion zone which has been bled into the expansion zone either by leakage or deliberately for purposes hereinafter set forth.

According to a further embodiment of the invention a method of producing a fibrous web is provided which comprises establishing a recirculatory flow of air wherein a stream of air from a supply zone maintained at superatmospheric pressure is injected into an expansion zone disposed immediately below said supply zone and maintained at atmospheric pressure, air from said expansion zone is sucked into a suction zone disposed below said expansion zone and maintained at subatmospheric pressure, and air from said suction zone is raised to superatmospheric pressure and fed to said supply zone, feeding fibres into said recirculatory flow of air at a point between said suction and supply zones and feeding said fibres in said flow of air into said supply zone and again in said air flow from said supply zone into said expansion zone, permitting fed fibres to fall through said expansion zone and form downwardly progressing zones of progressively decreasing fibre density therein, to form a web of fibres between said expansion and suction zones. In a further embodiment the air stream passed from the supply zone to the expansion zone constitutes only a portion of the air fed to the supply zone, the remaining portion of air being fed from the supply zone to a point between the supply zone and the entry of fibres into the air stream from the suction zone.

The method of the invention may be carried out as a batch process but is preferably carried out as a continuous process, the foraminous fibre-receiving member being caused to travel continuously across the outlet of the expansion chamber. For a given rate of feed the substance (i.e. the weight per unit area) of the web will then depend on the rate travel of the receiving member, decreasing as the rate of travel increases.

If desired, a plurality of supply zones disposed in series may be established all of which feed fibres into a single expansion zone, a plurality of suction zones being disposed in series beneath the expansion zone and corresponding to the supply zones.

The supply zone, especially when the fibres are wood fibres, may comprise a disintegrator such as a hammer-mill. When relatively narrow webs are required the disintegrator may be disposed directly above and feed fibres directly into the expansion zone. The recirculated air may then be used to carry the raw material to be disintegrated (e.g. flaked wood pulp) to the disintegrator. A hammer mill designed to operate with thin beaters is preferred as the disintegrator.

In one embodiment of the invention, therefore, a method is provided for producing a fibrous web, which comprises disintegrating a fibrous mass into its constituent fibres and passing said fibres directly into and downwardly through a substantially vertical expansion chamber to form downwardly progressing zones of progressively decreasing fibre density to a foraminous fibre-receiving member to form on such member a web, in which a pressure differential is maintained across said foraminous fibre-receiving member sufficient to hold the web against said member but insufficient to prevent lateral movement of said fibres during their downward passage through said expansion chamber.

In a further embodiment a method is provided for producing a fibrous web which comprises supplying a fibrous mass to at least one hammer-mill, disintegrating said mass in said hammer-mill or mills into its constituent fibres, feeding said fibres directly from said hammer-mill or mills into a substantially vertical expansion chamber disposed beneath said hammer-mill or mills and passing said fibres downwardly through said expansion chamber to form downwardly extending zones of progressively decreasing fibre density to a foraminous fibre-receiving member disposed beneath said expansion chamber to form a web thereon, a pressure differential being maintained across said foraminous fibre-receiving member sufficient to hold said web thereon but insufficient to prevent lateral movement of the fibres during their passage through the expansion chamber.

When larger widths of web are required, the volume of air required to transport fibre to the supply zone may be much greater than the maximum amount which can be allowed to flow through the expansion zone and still maintain the progressive decrease in fibre density in the expansion zone. In these circumstances a reservoir zone e.g. a cyclone is provided above the disintegrators. Fibre laden air is passed from the reservoir zone at a suitable rate to the disintegrator and thence into the expansion zone. Air leaving the suction zone is recirculated via a fibre-inlet to the reservoir zone. The excess air in the reservoir zone over and above that fed to the disintegrator is recirculated to a point immediately after the fibre inlet by a direct route which by-passes the disintegrator, expansion zone and suction zone. The use of such a reservoir also has the advantage that it has a smoothing out effect on fluctuations in fibre density in the feed to the disintegrator.

A plurality of expansion chambers may also be used in series but such a system is not preferred.

In order to prevent the blowing of fibres from the expansion chamber beyond the walls thereof on to the wire both in a direction opposite to and in the same direction as the direction of motion of the fibre-receiving member, air may be bled into the expansion chamber at those points where the fibre-receiving member passes under the walls of the expansion chamber. This may be achieved by providing the walls of the expansion chamber at these points either with adjustable panels or where the expansion chamber has a rectangular cross-section providing one pair of opposite sides under which the foraminous fibre-receiving means passes with means for adjusting the height thereof normal to the direction of travel of the fibre-receiving means e.g. said pair of opposite sides may be pivoted at the upper ends. Both natural e.g. wood pulp and cotton, and synthetic e.g. nylon, viscose and terylene fibres may be used.

The effective dimensions of the suction zone are variable and this is achieved by providing adjustable side walls in the expansion zone or preferably providing a cover for the suction zone adapted to be opened or closed in sections or a combination of both such means. Thus in the most preferred embodiment a plurality of slats are slidably mounted in frame members disposed in spaced parallel relationship across the width of and above the suction zone and below and transverse to the direction of the motion of the foraminous fibre-receiving member. Two sets of slats are provided which are inserted from opposite sides of the suction chamber such that the effective width of the suction chamber can be varied. Each slat is independently mounted so that the effective width of the suction zone can be varied if desired along its length. Where only a portion of the available area of the suction zone is required each pair of slats in the area not required may be replaced by single slats extending over the whole width of the suction zone.

The fibres fed into the expansion zone may be of one kind or may be a mixture of fibres. Further, the length of individual fibres may be varied and a mixture of fibres having different lengths may be fed into the expansion zone if desired.

According to a further feature of the invention filler materials may also be incorporated in the feed to the expansion zone. Examples of materials which may be used as fillers for various purposes are as follows:

China clay, kieselghur, activated carbon, carbon black, powdered graphite, powdered mica, powdered metals (e.g. aluminum or bronze powder) coconut shell fibre; sawdust, pigments and soluble or insoluble chemicals in powdered or granulated form e.g. boric oxide, boric acid, boron nitride, asbestos, glass fibre, silica gel, fullers earth and sodium chloride.

Binder may also be incorporated in powder form in a manner similar to the fillers and a web subsequently treated according to the specific process required for that particular binder. Thus, for example, phenolformaldehyde and melamineformaldehyde or ureaformaldehyde resins may be fed in in powdered form and subsequently polymerised to form a binder. A particularly preferred method of incorporating a binder is by admixing the polyvinyl alcohol fibres with the fibres which are introduced into the expansion zone to form the web, the web thus formed is impregnated with water and subsequently dried at a temperature at which the polyvinyl alcohol fibres dissolve in the entrained water.

By using a plurality of supply zones in series feeding into a single expansion zone it is possible to produce a laminated product of the same or of different fibres. Filler materials may be incorporated in one or more of the layers of the laminate. A wide variety of products is thus made possible by the method of the invention.

Another way in which laminates may be prepared according to the invention is to provide a scrim on the upper surface of the fibre-receiving member and to pass this scrim whilst on the fibre-receiving member underneath the expansion zone. In this method the fibres in the settling chamber form a web on the scrim and it is found that the web is interwoven with the scrim and can subsequently be treated as a laminate material. If desired, a second scrim can be laid on the top of the web thus produced so that the resulting product is a laminate comprising web having on each surface thereof a scrim. Binders may, of course, be incorporated in powdered form during the formation of the web on the first scrim. Similarly, filler materials may also be incorporated in the web at this stage. The scrim may be, for example, of nylon, cotton, viscose glass cloth, flannelette, terylene, polynosic and polythene (Net). The subsequent laminate after processing will have considerably enhanced strength whilst still retaining the other properties of a similar sheet without the scrim.

The web or laminate formed in the above manner may be fed directly into an impregnator for impregnation for example with a binder so with any other liquid which it is desired to introduce into the web.

The binders may take the form of natural or synthetic latices, e.g. natural rubber latex, Neoprene, styrene butadiene acrylonitrile butadiene, acrylic methyl methacrylate, polyvinyl alcohol, polyvinyl acetate, melamine-formaldehyde resins, or they may comprise solutions of starch, CMC, methyl cellulose or sodium silicate. In cases where a soluble filler compounds e.g. sodium chloride is used in admixture with fibres in the formation of the web, the impregnating liquid may comprise a saturated solution of said soluble material. This allows a web having a very high ratio of soluble material to fibres to be produced wherein the material itself acts as the binder for the sheet when it is dried.

The impregnated web passing out of the impregnator can then be fed into a drying section such as, for example, an infra-red tunnel having air circulation. The infre-red tunnel could, for example, be followed by a train of conventional drying cylinders. Following this any of the commonly used processes of finishing such webs, e.g. calendering or M.G. glazing may be undertaken.

The process of the invention therefore provides a means of producing continuously fully processed webs for a variety of purposes.

The humidity in the settling chamber may be adjusted to reduce or nullify electrostatic effects.

The fibre-receiving member in the apparatus for continuous production of webs or laminates is preferably an endless belt having an upper and lower pass, but may be of any other suitable construction e.g. a disc shaped member.

In continuous operation the web is built-up over the first few inches of travel of the foraminous fibre-receiving member under the expansion chamber and the amount of fibre build up at the forward end of the expansion chamber is small. The general movement of fibres from the injection area at the top of the expansion zone is therefore rearwardly and laterally. In order to avoid eddy currents forming in the forward end of the expansion chamber it is preferable to provide baffle means presenting an inwardly convex surface projecting rearwardly from the front wall of the expansion chamber. Preferably the baffle is parabolic in shape and extends from a point just below the top of the expansion chamber to a point just above the bottom of the expansion chamber. The gap left at the top may be used to inject air out of the surface of the baffle to prevent build up of stray fibres thereon and the gap at the bottom is preferably closed by a roller spaced from the foraminous fibre-receiving member.

Figure 2:
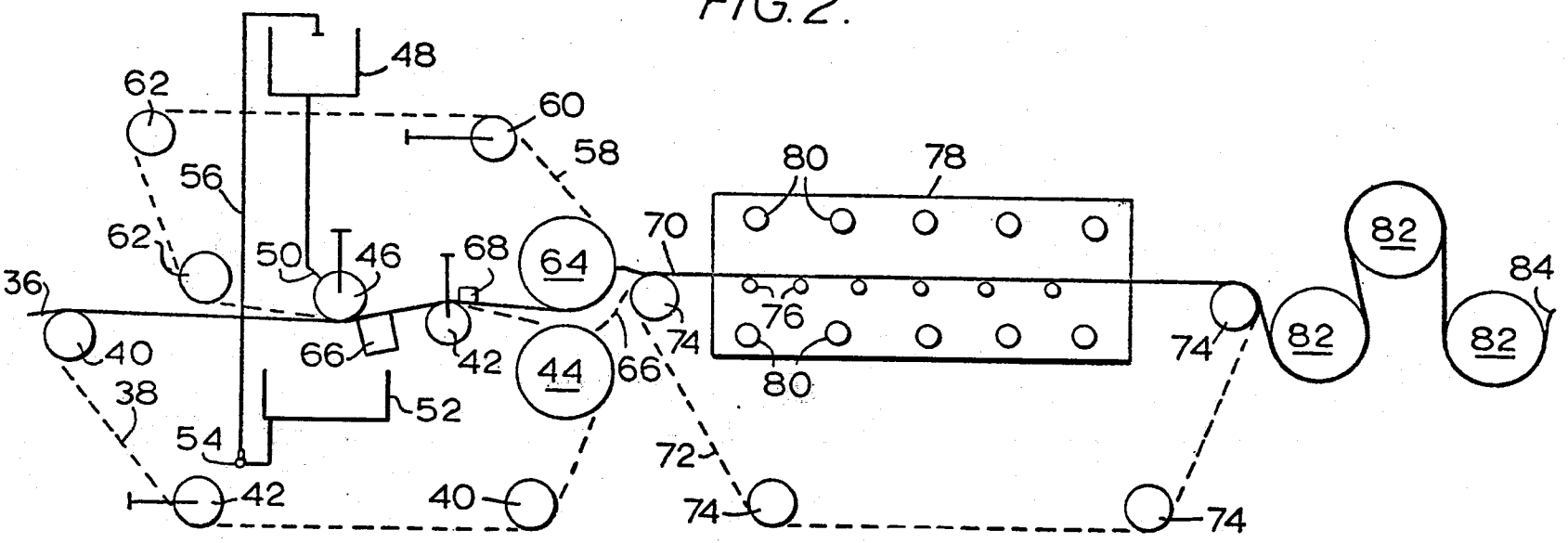

The invention will be further described with reference to the accompanying drawings in which:

FIGS. 1 and 2 illustrate a complete process incorporating one embodiment of the present invention for the production of a fibrous web, FIG. 1 showing the forming section and FIG. 2 the impregnating and drying sections of the process.

Figure 3:
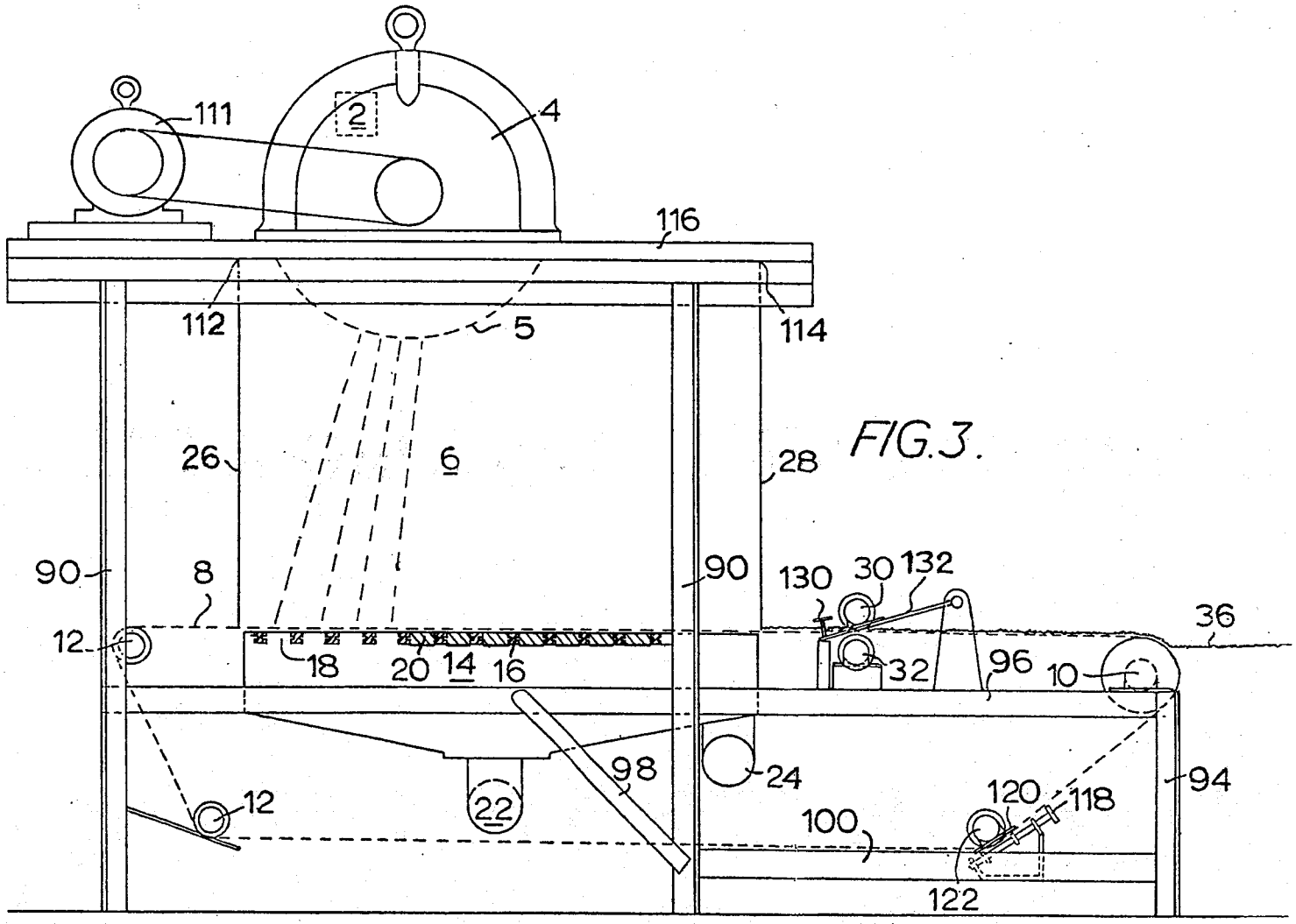
Figure 4:
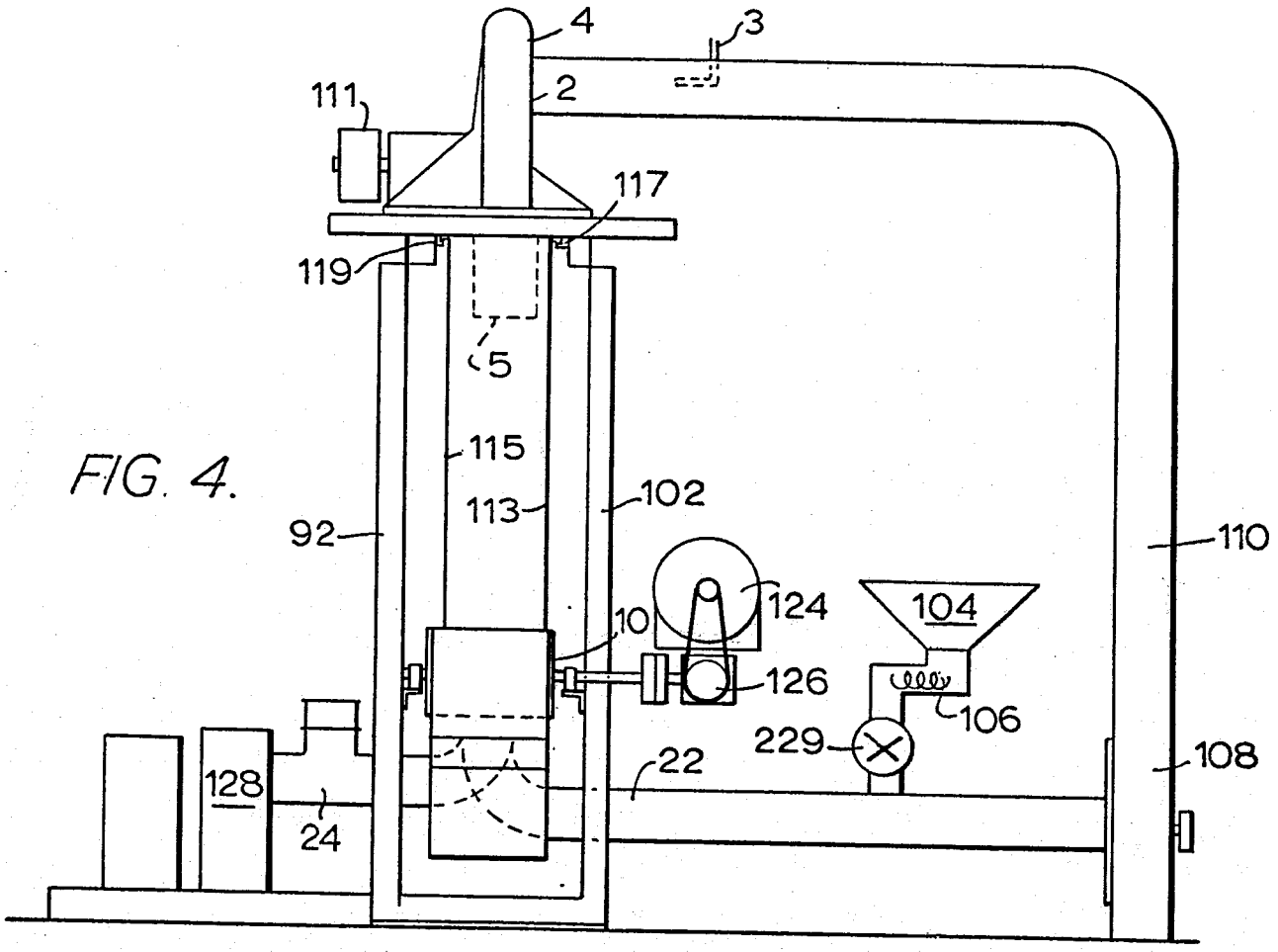
Figure 6A:
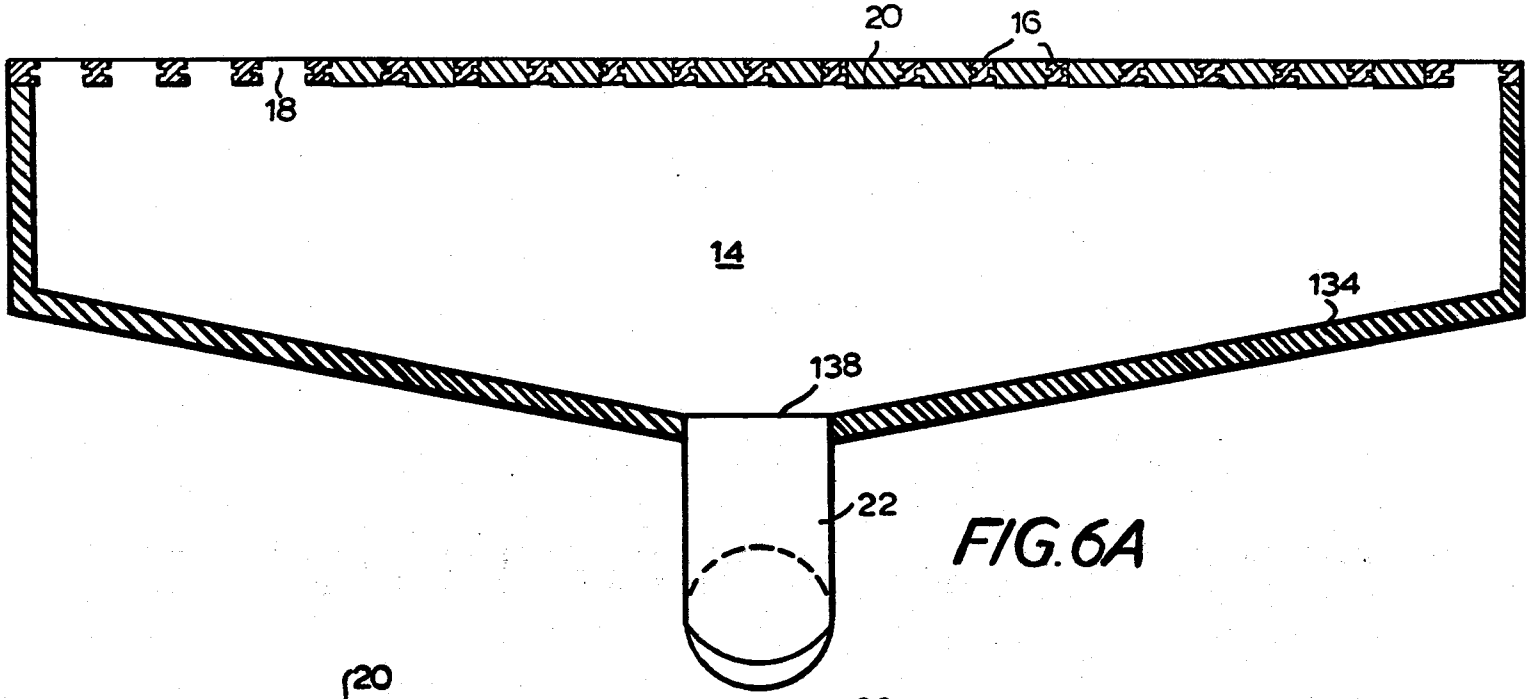
Figure 5:
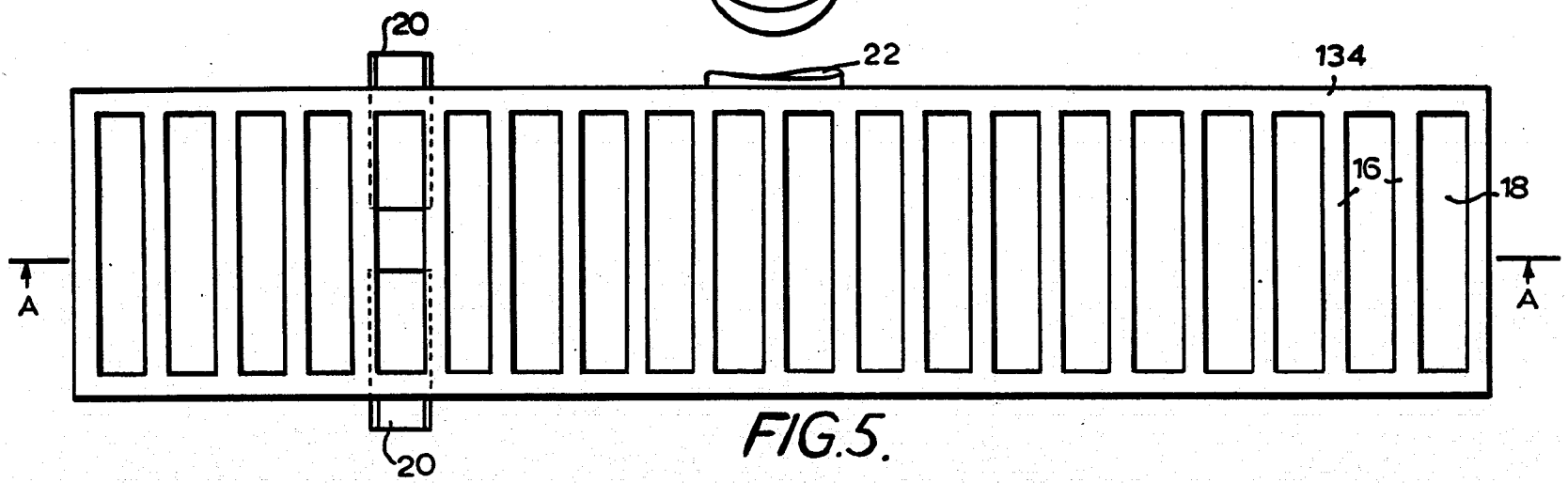
Figure 6B:
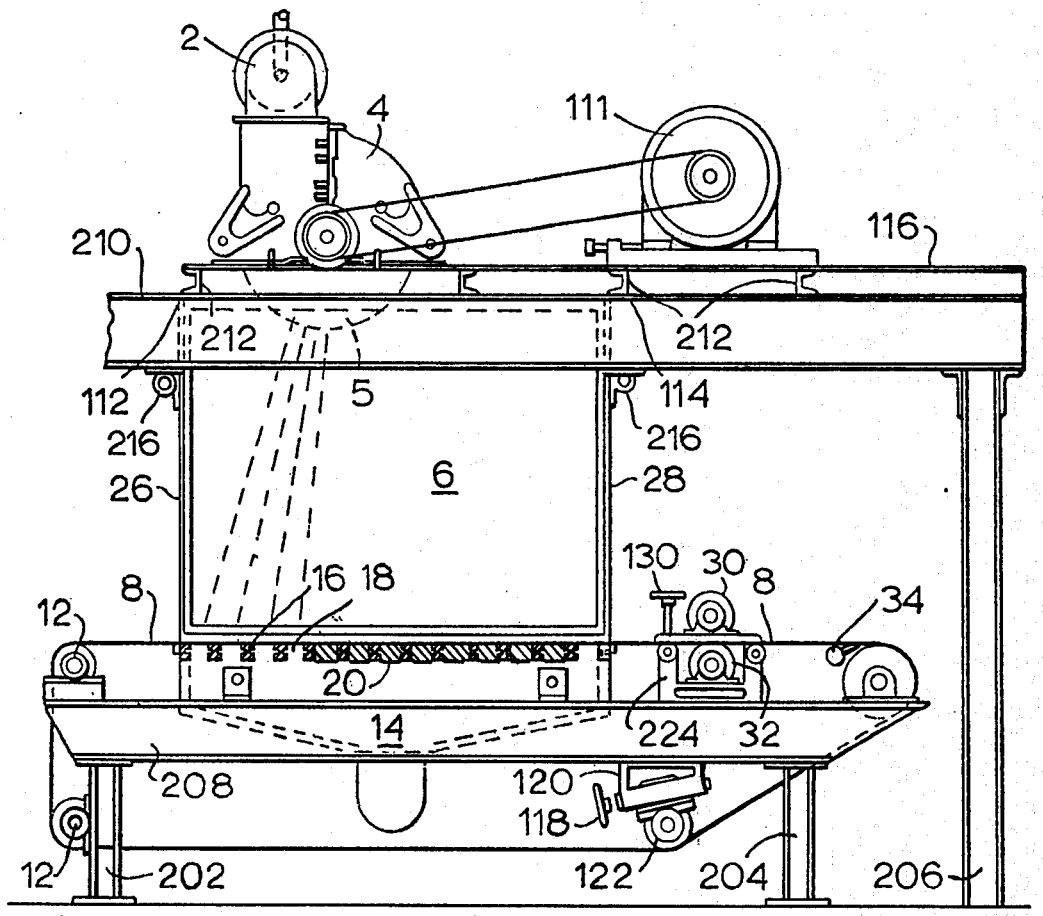
Figure 7A:
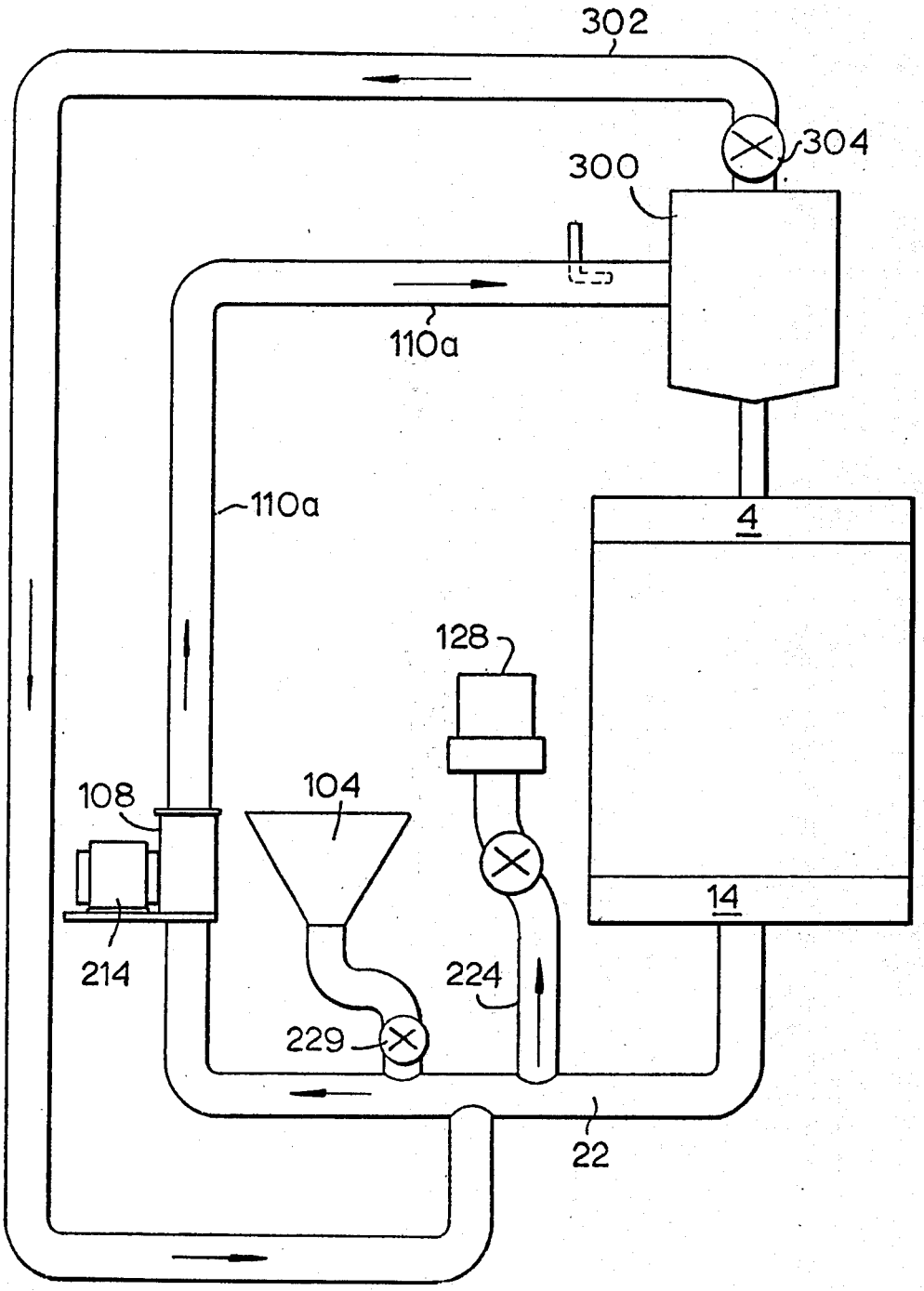
Figure 8:
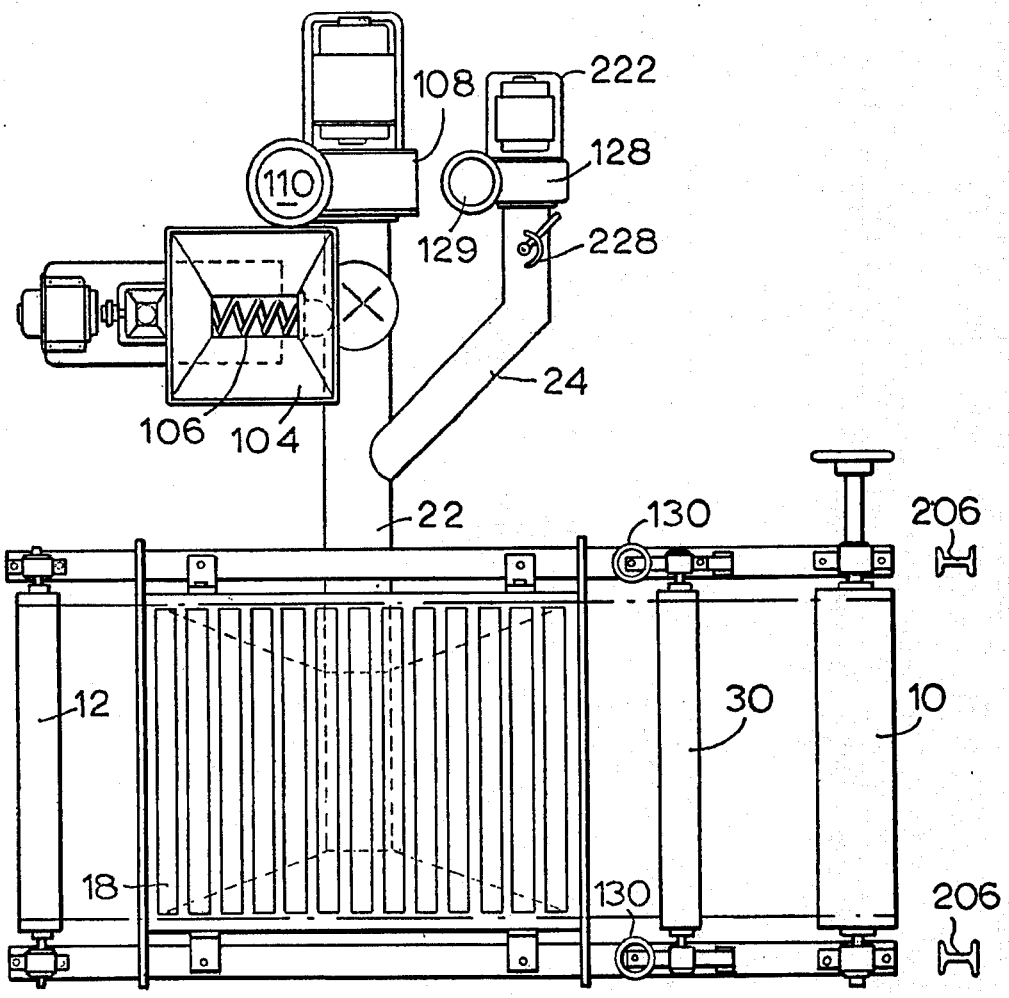

FIG. 3 is a detailed view of one form of web-forming apparatus according to the invention, FIG. 4 is an end view of the apparatus shown in FIG. 3, FIG. 5 is a plan view of a part of the apparatus shown in FIG. 4, and FIG. 6A is a section along the line A—A of FIG. 5, FIG. 6B is a front elevation detailed view of another form of the web-forming apparatus of the present invention, FIG. 7 is a part end elevation of the apparatus shown in FIG. 6, FIG. 7A is a diagrammatic representation of a modified version of the apparatus of FIG. 7, FIG. 8 is a plan view of the apparatus shown in FIGS. 6 and 7 with the upper portion thereof removed.

Referring to FIG. 1, fibrous material (or pulp) is fed at a predetermined rate in a flaked state through inlet 2, where it is moistened by the controlled addition of water through inlet 3, into hammer-mill 4 where the flaked and moistened pulp is completely defibred. The amount of moisture added to the fibrous material is carefully controlled in order to assist (i) in the formation of a homogeneous web (ii) in the control of the quality of fibrization (iii) in the dissipation of heat from the hammer-mill. The amount of water added depends on the operating conditions. The pulp is then blown through screen 5 into settling chamber 6 as a suspension of individual fibres. The fibres are deposited on a moving continuous wire-mesh 8 which passes across the open base of the settling chamber 6, preferably approximately 4 ft. below the entry of the pulp from the hammer-mill 4. The wire-mesh then passes over rollers 10 and 12, roller 10 being driven by a motor (not shown) thus driving the wire-mesh 8.

A suction box 14 is disposed beneath the open base of the settling chamber 6 so that the wire-mesh 8 passes between the settling chamber 6 and the suction box 14. The top of the suction box 14 consists of a series of 1 inch wide grooved wooden frame members 16 spaced 2 inches apart thus leaving a series of 2 inch wide openings 18. Each of the openings 18 is provided with one or two slats 20 slidably mounted between each pair of adjacent frame members. Two slats are provided where the effective area of suction is required so that the width can be varied, one slat being provided when the suction is not required and the slat is normally closed. Suction is provided by two fans of adjustable speed (not shown) which draw air out of the suction box 14 via outlets 22 and 24. The air extracted from the suction box 14 via outlet 22 is recirculated and is used to carry the feed into the hammer-mill 4 via inlet 2. The air withdrawn via outlet 24 is the excess air which has leaked in or has deliberately been allowed in as described below. The amount of air blown into the settling chamber 6 may be controlled by adjustment of the flow of recirculated air and by adjustment of the size of screen 5.

Two walls 26 and 28 of the settling chamber 6 are adjustable thus enabling a certain amount of air to be led onto the web or allows air to be passed directly into the left-hand end of the suction box 6.

A curved baffle can be provided affixed to the two side walls of the expansion chamber which are parallel to the direction of travel of the mesh 8. The baffle **28*a* is shaped so as to provide a gap 28*b* between the baffle 28*a* and the top of the expansion chamber and gap 28*c* between the lower portion of the baffle and mesh 8. The gap 28*b* enables air to be sucked or blown into the chamber which prevents fibres from agglomerating on the baffle surface and also further disperses the falling fibres. If desired the baffle 28*a* may replace wall 28. The baffle is not used when particulate filler materials are to be incorporated. Gap 28*c* may be adapted to bleed air into the chamber or may be sealed by roller 28*d***.

The thickness of the web may be controlled by the rate of feeding of the pulp into the settling chamber 6 and/or the speed of the wire-mesh 8.

The web still supported by the wire-mesh 8, after passing over the suction box 14, is passed through a pair of rollers 30 and 32, and is then strong enough to support its own weight.

Immediately prior to the wire-mesh passing over roller 10, a blower 34 is provided to free the web from the wire-mesh 8.

The web 36 then passes to the impregnation stage (see FIG. 2).

The web 36 is supported on a moving continuous wire-mesh 38 which passes over rollers 40, 42 and 44. The web 36 still supported by the wire-mesh 38 passes under roller 46 where it is impregnated by liquid drawn from reservoir 48 and spread on the roller 46 by means of a spreader 50. Excess liquid flows into tray 52 and is recirculated by pump 54 via pipe 56 to the liquid reservoir 48. A second moving continuous wire-mesh 58 passes round rollers 46, 60, 62 and 64. The impregnated web 36 is held firmly between the wire-mesh 58 and the first wire-mesh 38 as it leaves roller 46, thus preventing the flowing liquid from distorting the web. The two wire-meshes 38 and 58 may be tensioned or slackened, depending upon whether it is desired to compress the web or not. Tensioning is effected by adjustment of rollers 42, 46 and 60.

Further excess liquid is removed from the web by a suction box 66, passed to a separator and then recirculated via tray 52, pump 54 and pipe 56 to liquid reservoir 48. It is better to remove the impregnated web from the upper wire-mesh 58 first.

Normally the web is allowed to remain in contact with the lower wire-mesh 38 until the wire-mesh is just passing over roller 44. The impregnated web then leaves the wire-mesh 38 and follows the path 66, indicated by a dotted line, to the drying section.

For certain types of web, however, it is advantageous to remove the impregnated web from the lower wire-mesh 38 before removing it from the upper wire-mesh 58. In order to maintain the web in contact with the upper wire-mesh a suction box 68 is positioned just after the web leaves roller 42. The impregnated web thus remains in contact with upper wire-mesh 58 until the wire-mesh 58 passes over roller 64. The web then leaves the wire-mesh 58 and passes into the drying section along path 70.

The wires in the impregnator are kept clean by spraying them with water at appropriate intervals. The impregnated web supported by continuous wire-mesh 72, which passes over rollers 74 and 76, passes through infre-red tunnel 78 which is filled with infra-red lights 80. The web is thus dried by the infra-red lights 80 and by circulation of air through the tunnel.

If desired the web may then be passed over a series of drying cylinders 82.

The dried sheet 84 may then, if desired, be subjected to a finishing process e.g. calendering or M.G. glazing.

In FIGS. 3, 4, 5 and 6A the numbers used in relation to FIGS. 1 and 2 are used to designate similar parts.

Referring to FIGS. 3 and 4, the forming section of the apparatus is mounted on a frame comprising a number of angle irons 90, 92, 94, 96, 98, 100, 102. A feed hopper 104 is connected via its outlet and a rotary valve 229 to pipe 22, a vibra-screw feeder 106 being provided in the outlet of the hopper. Pipe 110 connects pipe 22 to hammer-mill 4, a fan being disposed at point 108 in pipe 110. A spray nozzle projects into pipe 110 at 3 previously described in relation to FIG. 1.

Hammer-mill 4 and its drive motor 111 is mounted on the roof 116 of the settling chamber 6, the screen 5 of the hammer-mill projecting into the settling chamber 6. Settling chamber 6 has two adjustable walls 26 and 28 which are hinged at 112 and 114 respectively to roof 116 thereof. The remaining two walls 113 and 115 of settling chamber 6 are mounted over slides 117 and 119 respectively for lateral movement thereof. A continuous wire-mesh 8 is mounted on drive roll 10 and tensioning rolls 12 and 122, the tension being adjusted by tightening or loosening screws 118 attached to frame 120 carrying roller 122. The drive roll 10 is driven by a variable speed motor 124 through a gear box 126.

A suction box 14 is disposed below the settling chamber 5. Two outlet pipes 22 and 24 are provided in the suction box, the outlet pipe 24 leading to fan 128 and having an opening to atmosphere 129 in which is disposed a butterfly valve (not shown).

Pressing rolls 30 and 32 are mounted to receive the mesh 8 between them. The gap between rolls 30 and 32 may be adjusted by screw 130 mounted on frame 132 carrying the roll 30.

In operation, the fibrous mass is fed from hopper 104 by the screwfeeder 106, (for example, a vibra screwfeeder) to pipe 22 by way of rotary valve 229. It has been found expedient to incorporate some form of rotary seal between hopper 104 and pipe 22 otherwise variations in the feed may occur, and also leakage into the system of more air causing pressure variations. These may lead to variations of pressure within the expansion chamber itself and result in a non-uniform web being formed. The pressure fluctuations are, of course, of less importance when a reservoir chamber, e.g. a cyclone as shown diagrammatically in FIG. 7A is also installed, since such a chamber tends to level out variations in pressure.

The fibrous mass is then passed via pipe 110 to hammer-mill 4 where the fibrous mass is disintegrated into its constituent fibres. Any additional moisture required may be added to the fibres through spray nozzle 3 prior to disintegration. The fibres are then passed into the settling chamber 6 through screen 5 of the hammer-mill 4. The fibres are passed downwardly through the settling chamber 6 via an uninterrupted path to the continuous wire-mesh 8 which is continuously moving across the outlet from the settling chamber to form a web thereon. The suction box 14 provides a pressure differential across the wire-mesh and thus serves to maintain the web in contact with the wire-mesh 8 while not preventing the lateral movement of the fibres during their downward passage through the settling chamber 6. Air is drawn from the suction box through pipes 22 and 24. The air removed through pipe 22 is recirculated with more fibrous matter fed into pipe 22 from the hopper 104.

The amount of air removed through pipe 24 may be regulated depending on the amount of air bled into the settling chamber. The hinged walls 26 and 28 of the settling chamber may if desired be raised at their lower ends to allow air to bleed into the settling chamber at these points.

The web is carried out of the settling chamber 6 as it is formed on mesh 8 and passes between rolls 30 and 32 which compress the web slightly. The web is removed from the mesh 8 as it passes over driving roll 10 and may then be further treated as desired.

Referring to FIGS. 5 and 6 suction box 14 comprises a number of grooved wooden frame members 16 (usually 1 inch in width) disposed in spaced relationship across a funnel shaped tray 134 leaving a series of openings 18 (usually 2 inches in width). A pair of slats 20 comprising tongues 136 are slidably mounted between each adjacent pair of the wooden frame members 16. Where the openings 18 are required to be closed a single slat may replace the pair of slats.

An opening 138 is provided in the base of the tray 134 through which air is removed from the suction box. The opening communicates with outlet pipe 22 at the end of which is disposed a fan (not shown). A second opening in the suction box 14 which connects with pipe 24 is not shown in FIGS. 4 and 5.

Referring to FIGS. 6B, 7, 7A and 8 the forming section of the apparatus is mounted on a framework comprising a number of vertical angle irons 202, 204 and 206 and a number of horizontal angle irons 208, 210 and 212. A feed hopper 104 is connected via its outlet to a vibrascrew feed 106 (FIG. 8) which passes material from the hopper into pipe 22. Pipe 22 is connected at one end to the inlet of a fan 108 driven by a motor 214, the outlet of said fan being connected via pipe 110 to the inlet of hammer-mill 4. Hammer-mill 4 and its drive motor 111 are mounted on roof 116 of a settling chamber 6, the screen 5 of the hammer-mill projecting into the settling chamber 6 is disposed above a suction box 14 and consists of two walls 26 and 28 which are hinged at 112 and 114 respectively to horizontal angle irons 210, and two walls 113 and 115 which are slidably mounted on bars 216. The walls 113 and 115 may thus be moved to increase or decrease the width of the settling chamber 6. Blanking plates 218 and 220 (FIG. 7) are provided to cover the area of the suction box 14 which is exposed by moving walls 113 and 115 inwardly.

Suction box 14 disposed below the settling chamber 6 is connected to the remaining end of pipe 22. A second pipe 24 is joined to pipe 22 at an intermediate point therein and leads via a fan 128 (driven by motor 222) and pipe 129 to atmosphere. A butterfly valve (not shown) is preferably disposed in pipe 129.

A continuous wire-mesh 8 is mounted on drive roll 10 guide rolls 12 and tensioning roll 122 slidably mounted in frames 120. Frames 120 are rigidly attached to angle irons 208. Screws 118 disposed in frames 120 are adapted to determine the position of roll 22 in frames 120 and therefore the tension on wire-mesh 8.

Angle iron 208 carries a frame 224 on which are mounted pressing rolls 30 and 32 (FIG. 6) disposed respectively above and below continous screen 8.

The gap between rolls 30 and 32 may be adjusted by screws 130 mounted in frame 224.

Two slats 20 (FIG. 6) are slidably disposed in each of the gaps 18 between frame members 16 of suction box 14 so that these openings 18 may be opened or closed as desired by lateral movement of each pair of slats outward or inward as the case may be. In general since only the first half dozen or so of the slats 20 used to be in the open position, the remaining pair of slats are preferably replaced by a single slat covering the whole width of the suction chamber. Usually one or other of the last two gaps 18 in the sequence adjacent the forward end of the suction box are left open.

A blower 34 is provided adjacent the driving roller 10 and may be operated as and when desired.

Figure 9:
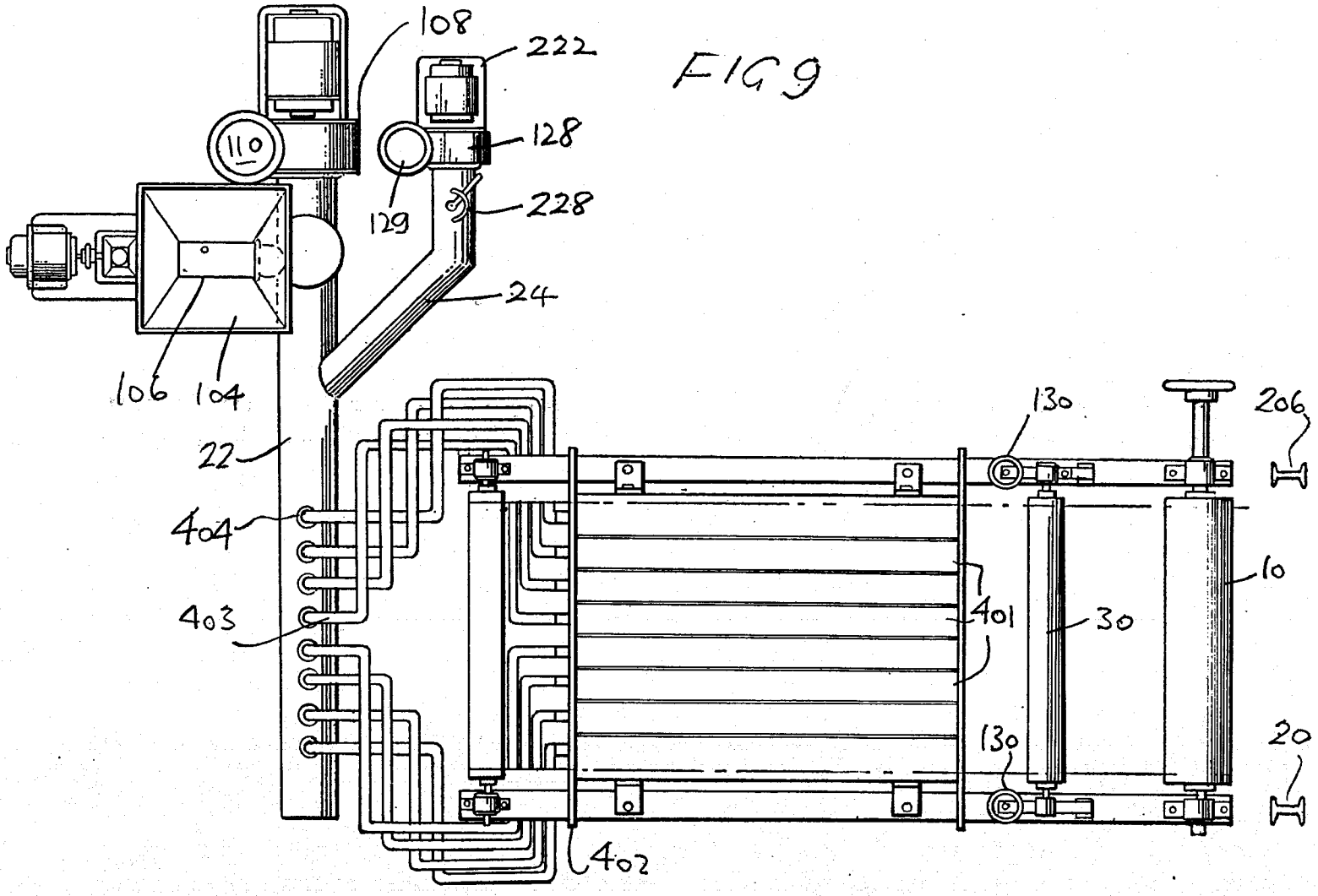
Figure 11:
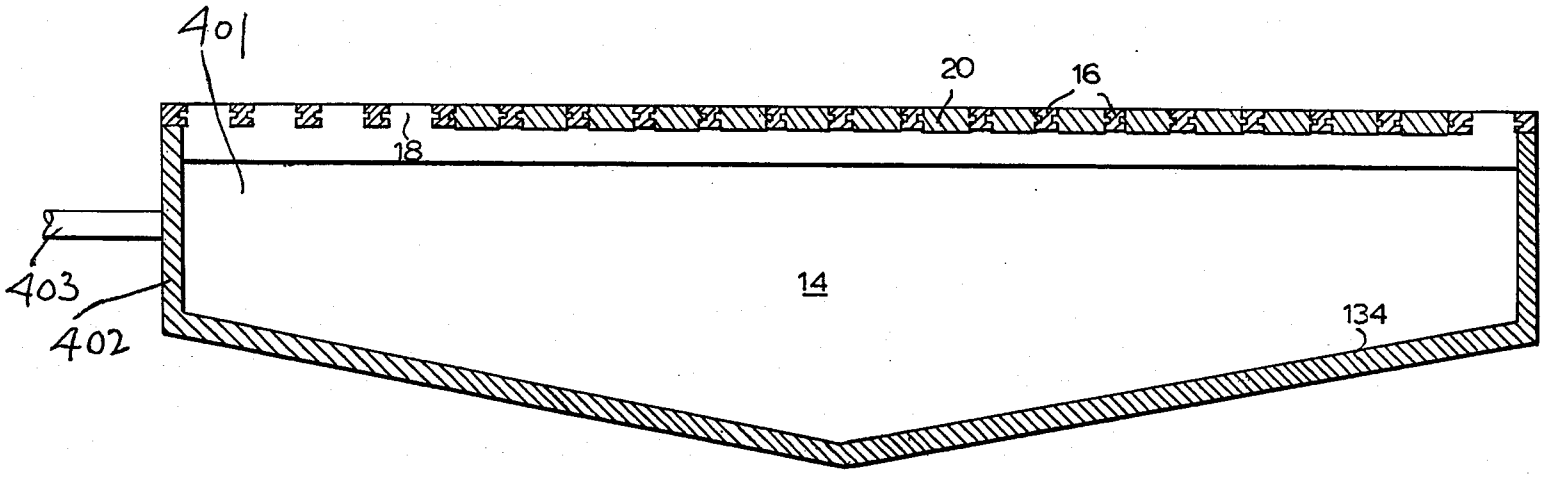
Figure 10:
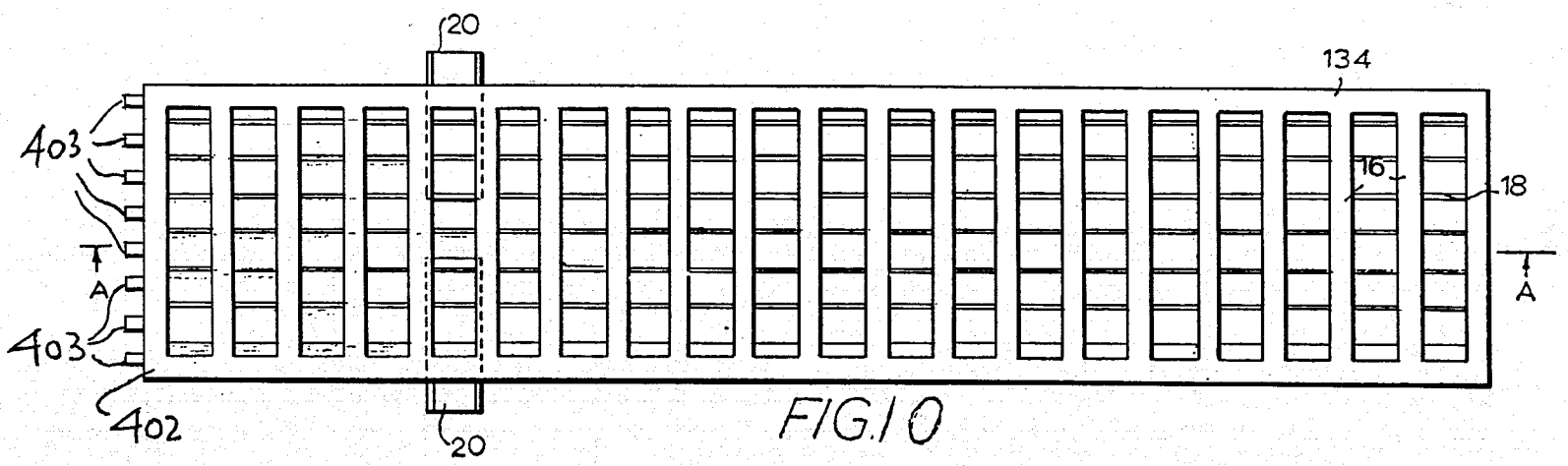

The operation of the embodiment shown in FIGS. 6B, 7 and 8 is similar to the operation of the apparatus of FIGS. 3 and 4 with the exception that the side walls 113 and 114 in the apparatus of FIGS. 7, 8 and 9 may be slid on bars 216 to vary the width of the settling chamber 6 and blanking plates 218 and 220 are provided to cover the portions of the suction box which are exposed when the settling chamber 6 is made narrower by moving side walls 113 and 114 inwardly.

The modification shown in FIG. 7A of the drawings illustrates the use of a reservoir which feeds a proportion of its intake of fibre laden air to the hammer-mill. Thus referring to FIG. 7A conduit 110A leads to reservoir 300 (instead of the hammer-mill 4 as in FIG. 7), fibre-laden air fed to reservoir 300 via conduit 110A being fed from reservoir 300 to hammer-mill 4 and then through expansion chamber 26. The excess air fed to reservoir 300 is recirculated through conduit 302 via valve 304 to conduit 22 where it supplements the air circulated from suction box 14.

In the following examples the material was produced at a width of 12½ inches. The disintegrator (hammer mill) had a screen 4 inches wide and 21½ inches in length. Part of the air from the suction box was recirculated but most of it was blown out into the atmosphere without any attempt being made to recover any fibres and/or filler being carried out with it. The moisture added to the feed to the hammer mill was specific to the particular trial carried out and it might have to be varied to suit particular conditions from run to run. Generally speaking dusty atmosphere generated during bag formation means that more moisture will be needed. The feed rates are approximate and might have to be varied slightly during the run to get the correct basis weight of the sheet. The density of the finished material is controlled by the squeezing between the impregnator wires and the amount of squeezing was controlled to obtain the density given in the following examples.

EXAMPLE NO. 1

A mixture of high alpha wood pulp 1 part and active carbon (Coconut shell) 2 parts was fed to the disintegrator (hammer mill) fitted with a 1.96mm diameter hole perforated screen, at the rate of 40 lbs/hr with the foraminous receiving member (30 mesh phosphorbronze) moving at a speed of 4 ft/min. The feed to the disintegrator had a moisture content of 60 parts water to 100 parts of fibre and active carbon mixture to dissipate the heat of disintegrator and also to maintain the correct humidity in the settling chamber. At the same time a bleached cotton scrim of 50 × 40 count was run on the foraminous member just before the latter entered the settling chamber so that it passed along the base of the settling chamber carried by and upon the foraminous member. An evenly distributed mixture of fibres and active carbon was deposited onto the scrim. The composite web was then transferred to a twin wire impregnator where it was impregnated with a modified polyacrylate latex of 8% solids content. The excess latex emulsion was removed partly by squeezing between the two wires of the impregnator and partly by a suction box situated below the bottom wire of the impregnator. The impregnated web was then partially dired in an infra-red tunnel and then passed over a bank of paper drying cylinders for final drying.

The resulting product had the following properties:

| | | |
|---|---|---|
| Basis Weight (g/m²) | | 1000 |
| Caliper (mm) | | 2.43 |
| Apparent Specific Gravity (gm/cm³) | | 0.41 |
| Pore Size: | Maximum, microns (Bubble Point) | 42 |
| | Mean, microns (Boil Point) | 23 |
| Water Flow Rate (liters/sq.meter/hour/25 cm.Hg | | 51,000 |
| Wet Burst (kg/cm²) (Mullen) | | 3.5 |
| Active Carbon Content (%) | | 50 |

The resulting product carries a very high loading of active carbon which firmly bonded. It enables a very convenient use of active carbon in a plate and frame type of press with the following further advantages over the conventional methods of precoating a slurry of active carbon:

1. No channelling in the carbon bed
2. Higher flow rates and lower pressure drops than with a precoat.
3. No effect of sudden pressure changes.
4. Ease of removal and replacement.

Such papers are very useful in the purification of solutions requiring the use of active carbon e.g. electroplating solutions.

EXAMPLE NO. 2

A material produced according to the procedure and furnish of EXAMPLE No. 1 but where the impregnating liquid i.e. 8% modified polyacrylate latex emulsion is replaced by a 10% p.v.c. latex emulsion. This material has generally similar physical properties to the material of Example No. 1 but has the added advantage of being resistant to highly alkaline conditions.

EXAMPLE NO. 3

A material produced according to the procedure and furnish of Example No. 1 but where the impregnating liquid was a 10% special p.v.c. latex emulsion. This latex emulsion is completely non-toxic and all its ingredients have F.D.A. clearance for contact with foodstuffs. The resulting product was found to be an effective means of removal of excess, free and residual chlorine from drinking water

EXAMPLE No. 4

A mixture of high alpha wood pulp 95 parts and Polyvinyl alcohol fibres 5 parts was fed to the disintegrator (fitted with a perforated screen with 1.96mm diameter holes) at the rate of 7.5 lbs/hr with the foraminous receiving member (30 mesh phosphorbronze) moving at a speed of 4.3 ft/min. The feed to the disintegrator had a moisture content of 80 parts water to 100 parts of fibre to dissipate the heat of disintegrator and also to maintain the correct humidity in the settling chamber. The polyvinyl alcohol fibres have the special property of being insoluble at ordinary temperatures but dissolving at elevated temperatures (80° C in this case). They are described and claimed in British Pat. No. 895,081. An evenly distributed mixture of fibres was deposited onto the foraminous member. The resulting web was impregnated as in Example No. 1 with a 0.25% solution of melamine formaldehyde. The impregnated web was then dried as in Example No. 1.

The resulting product had the following properties:

| | | |
|---|---|---|
| Basis Weight (g/m²) | | 125 |
| Caliper (MM) | | 0.61 |
| Apparent Specific Gravity (gm/cm²) | | 0.20 |
| Air Permeability (Liters/minute/10sq.cm/10cm water gauge) | | 220 |
| Pore Size: | Maximum,microns (Bubble Point) | 105 |
| | Mean,microns (Boil Point) | 73 |
| Burst (kg/cm²) (Mullen) | | 0.49 |
| Tensile Strength | Dry | 1.0 (kg/15mm with 9% stretch) |
| Tensile Strength | Wet | 0.35 (kg/15mm with 20% stretch) |
| Tear (Elmendorf) | Machine direction | 54gm |
| Tear (Elmendorf) | Cross direction | 54gm |

The resulting material is anisotropic, very absorbent and has wet strength.

It is suitable for further impregnation with Phenol formaldehyde resin for conversion into pleated elements for air and oil filters.

EXAMPLE NO. 5

A material as in Example No. 4 but where the impregnating liquid is water alone. The omission of the melamine formaldehyde leaves the material with no wet strength but there is no acidity in the material either. This makes it suitable as a base paper for polyester mouldings.

EXAMPLE NO. 6

A mixture of bleached kraft 38 parts, (44 mesh) silica gel granules 57 parts and polyvinyl alcohol fibres 5 parts was fed to the disintegrator (fitted with a perforated screen with 1.5 mm diameter holes) at the rate of 15 lbs/hr with the foraminous receiving member (30 mesh phosphor-bronze) moving at a speed of 3.5 ft/min. The feed to the disintegrator had a moisture content of 45 parts water to 100 parts of fibres and silica gel mixture to dissipate the heat of disintegrator and also to maintain the correct humidity in the settling chamber. At the same time a bleached cotton scrim of 30 × 20 count was run on the foraminous member just before the latter entered the settling chamber so that it passed along the base of the settling chamber carried by and upon the foraminous member. An evenly distributed mixture of fibres and silica gel was deposited onto the scrim. The composite web was then transferred to the impregnator where it was impregnated with water and then dried by the method of Example No.1. The polyvinyl alcohol fibres are the same as described in Example No.4. The resulting product had the following properties.

| | |
|---|---|
| Basis Weight (g/m²) | 310 |
| Caliper (mm) | 1.14 |
| Apparent Specific Gravity (gm/cm³) | 0.28 |
| Silica gel content (%) | 45 |

The resulting material had good desiccating properties and can be used in place of silica gel granules packed in sachets.

A novel method of using this material is to make another material as outlined in the example but without the scrim backing. The non-scrim material is fluted and fixed to the scrim backed material to make a corrugated medium. The corrugated material is rolled into the form of a wheel. This silica gel wheel can be used as a continuous desiccating medium by allowing the air to be dried to pass through the holes in part of the wheel while the remainder of the wheel is being regenerated by passing hot air in the other direction. One such application may be described in British Patent No. 770,201.

EXAMPLE No. 7

A mixture of bleached kraft 20 parts, Activated Fuller's Earth 80 parts and Polyvinyl alcohol fibre 4 parts was fed to the disintegrator (fitted with a perforated scrim with 4.75mm diameter holes) at the rate of 79 lbs/hr with the foraminous receiving member (30 mesh phosphor-bronze) moving at a speed of 2 ft/min. The feed to the disintegrator had a moisture content of 10 parts water to 100 parts of fibre and Fullers Earth mixture to dissipate the heat of disintegrator and also to maintain the correct humidity in the settling chamber. At the same time a bleached cotton scrim of 50 × 40 count was run on the foraminous member just before the latter entered the settling chamber so that it passed along the base of the settling chamber carried by and upon the foraminous member. An evenly distributed mixture of fibres and Fullers earth was deposited onto the scrim. The composite web was then impregnated with water and then dried by the method of Example No. 1. The Polyvinyl alcohol fibre used was the same as in Example No. 4.

The resulting product had the following properties:

| | | |
|---|---|---|
| Basis Weight (g/m²) | | 3,200 |
| Caliper (mm) | | 3.32 |
| Apparent Specific Gravity (gm/cm²) | | 0.95 |
| Pore Size: | Maximum,microns (Bubble Point) | 30 |
| | Mean,microns (Boil Point) | 17 |
| Water Flow Rate (Liters/sq.meter/hr 25 cm.Hg) | | 780 |
| Fullers Earth Content (%) | | 70 |

The sheet has been designed for the bleaching of vegetable oils. It can be used in a plate and frame press where it has all the advantages of the carbon sheet described in Example No. 1.

EXAMPLE No. 8

A mixture of high alpha pulp 1 part and diatomaceous earth 1 part was fed to the disintegrator (fitted with a perforated screen with 1.5mm diameter holes) at the rate of 30 lbs/hr with the foraminous receiving member (30 mesh phosphor-bronze) moving at a speed of 3 ft/min. The feed to the disintegrator had a moisture content of 65 parts water to 100 parts of fibre and diatomaceous earth mixture to dissipate the heat of disintegrator and also to maintain the correct humidity in the settling chamber. At the same time a bleached cotton scrim of 30 × 20 count was run on the foraminous member just before the latter entered the settling chamber so that it passed along the base of the settling chamber carried by and upon the foraminous member. An evenly distributed mixture of fibre and diatomaceous earth was deposited onto the scrim. The composite web was then impregnated with a liquid containing 8% solids of an acrylic latex and 1% melamine formaldehyde syrup by the method of Example No. 1.

The resulting product had the following properties:

| | | |
|---|---|---|
| Basis Weight (g/m²) | | 750 |
| Caliper (mm) | | 2.13 |
| Apparent Specific Gravity (gm/cm³) | | 0.36 |
| Pore Size: | Maximum,microns (Bubble Point) | 63 |
| | Mean,microns (Boil Point) | 54 |
| Water Flow Rate (Liters/sq.meter/hr 25 cm.Hg) | | 212,000 |
| Diatomaceous Earth Content (%) | | 35 |

The material can be used in place of conventional precoats and has all the advantages of the material described in Example No. 1.

EXAMPLE No. 9

A mixture of bleached kraft flakes 1 part and active carbon 1 part was fed to the disintegrator (fitted with a perforated screen with 1.5mm diameter holes) at the rate of 30 lbs/hr with the foraminous receiving member (30 mesh phosphor-bronze) moving at a speed of 4.3 ft/min. The feed to the disintegrator had a moisture content of 40 parts water to 100 parts of fibre and active carbon mixture to dissipate the heat of disintegrator and also to maintain the correct humidity in the settling chamber. At the same time a cotton flanelette with the raised nap upwards was run on the foraminous member just before the latter entered the settling chamber carried by and upon the foraminous member. An evenly distributed mixture of fibres and active carbon was deposited onto the flanelette. The composite web was impregnated by the method of Example No. 1 with a mixture of 10% acrylic latex and 2% melamine formaldehyde syrup. The impregnated web was then dried as in Example No. 1.

The active carbon used was a coconut shell type and had very good odour absorption properties.

The resulting product had the following properties:

| | |
|---|---|
| Basis Weight (g/m²) | 700 |
| Caliper (mm) | 2.13 |
| Apparent Specific Gravity (gm/cm³) | 0.33 |
| Active Carbon Content (%) | 29 |

The advantages and use of this material are described in our Copending British Patent Application No. 35075/68.

EXAMPLE NO. 10

A mixture of high alpha wood pulp 1 part and active carbon 1 part was fed to the disintegrator (fitted with a perforated screen with 1.5mm diameter holes) at the rate of 26 lbs/hr with the foraminous receiving member (30 mesh phosphor-bronze) moving at a speed of 8.3 ft/min. The feed to the disintegrator had a moisture content of 40 parts water to 100 parts of fibre and active carbon mixture to dissipate the heat of disintegrator and also to maintain the correct humidity in the settling chamber. At the same time a loomstate cotton scrim of 30 × 20 count was run on the foraminous member just before the latter entered the settling chamber so that it passed along the base of the settling chamber carried by and upon the foraminous member. An evenly distributed mixture of fibres and active carbon was deposited onto the scrim. The composite web was then transferred to the impregnator where it was impregnated by the method of Example No. 1 with a soft acrylic latex of 4% solids content. The impregnated web was then dried as in Example No. 1.

The active carbon used was a coconut shell type and had very good odour absorption properties.

The resulting product had the following properties:

| | | |
|---|---|---|
| Basis Weight (g/m²) | | 280 |
| Caliper (mm) | | 1.65 |
| Apparent Specific Gravity (gm/cm³) | | 0.169 |
| Air Permeability (Liters/minute/10sq.cm/10cm water gauge) | | 125 |
| Pore Size: | Maximum,microns (Bubble Point) | 103 |
| | Mean,microns (Boil Point) | 85 |
| Active Carbon Content (%) | | 32 |

This example is also further described as example 3 in our Copending British Patent Application No. 20884/69.

The following examples were carried out with a disintegrator (hammer mill) which had a total screen area of 22.5 inches × 24.5 inches. Screens with various sizes of openings were fitted and these are given in the examples. A 4 inch blanking plate was fitted around the screen on the inside to give an effective screen width of 14.5 inches × 16.5 inches in length. A baffle as shown in FIG. 1 along with a sealing roller were used in the examples. The baffle and sealing roller were 57 inches wide and the sides of the settling chamber were kept 57 inches apart. The sheets were formed at various widths as given in the examples, this width being controlled by altering the width of the screen zone by the position of the slides. A return loop was used at various openings as a control for getting good formation and the position of its openings was altered during the runs to suit various conditions. part of the air from the suction box was sent to a bag filter and part of it blown into the atmosphere. The hammer mill was fed through a Vibra screw feeder with a standard 4 inch diameter screw and tube. The rate of feed was controlled by the number of revolutions per minute of the screw to give the required basis weight as given in the examples. The comments relating to moisture content of feed and the squeezing of the impregnator wires as given for the previous set of examples are also pertinent to the following examples.

EXAMPLE NO. 11

Flaked high alpha pulp was fed to the disintegrator (fitted with a perforated screen with slots 1.5 mm wide and 12.7 mm in length). The vibra screw feeder had a speed of 6.5 r.p.m. The web was formed at a width of 46 inches with the foraminous receiving member (30 mesh phosphor-bronze) moving at a speed of 3.5 ft/min. The feed to the disintegrator had a moisture content of 55 parts water to 100 parts of fibre to dissipate the heat of disintegrator and also to maintain the correct humidity in the settling chamber. At the same time a bleached cotton scrim of 50 × 40 count was run on the foraminous member just before the latter entered the settling chamber so that it passed along the base of the settling chamber carried by and upon the foraminous member. An evenly distributed web of fibres was deposited onto the scrim. The composite web was then impregnated as in Example 1 with a liquid containing a 10% acrylic latex and 2% melamine formaldehyde syrup.

The impregnated web was dried as in Example 1 and had the following properties:

| | | |
|---|---|---|
| Basis Weight (g/m²) | | 260 |
| Caliper (mm) | | 1.17 |
| Apparent Specific Gravity (gm/cm³) | | 0.24 |
| Air Permeability (Liters/minute/10sq.cm/10cm water gauge) | | 195 |
| Pore Size: | Maximum,microns (Bubble Point) | 98 |
| | Mean,microns (Boil Point) | 88 |
| Water Flow Rate (Liters/sq.meter/hr/ 25 cm.Hg) | | >400,000 |
| Wet Burst (kg/cm²) (Mullen) | | 3.3 |

The material has a very open and uniform structure. The scrim backing also gives it considerable wet strength thus making it suitable for high speed filtration use in a plate and frame press without the need of backing cloths. The high air permeability also makes it suitable for air filtration.

EXAMPLE NO. 12

A material as in Example No. 5 were the high alpha pulp was replaced by a bleached kraft pulp. The speed of vibra screw feeder was 5 r.p.m. The web was formed at a width of 39 inches with the foraminous fibre receiving member moving at 5.0 ft/min to give a material having a basis weight of 200 g/m² with the following properties:

| | | |
|---|---|---|
| Basis Weight (g/m²) | | 200 |
| Caliper (mm) | | 0.71 |
| Apparent Specific Gravity (gm/cm²) | | 0.27 |
| Air Permeability (liters/minute/10sq.cm/10cm water gauge) | | 75 |
| Pore Size: | Maximum, microns (Bubble Point) | 62 |
| | Mean, microns (Boil Point) | 48 |
| Water Flow Rate (liters/sq.meter/hr/25 cm.Hg) | | >4000,000 |

This material had a much finer pore structure than the material of the previous example thus making it more suitable for finer filtration.

EXAMPLE NO. 13

Flaked high alpha wood pulp was fed to the disintegrator (fitted with a perforated screen with 2.45mm diameter holes. The vibra screw feeder speed was 180 r.p.m. with the foraminous receiving member (30 mesh phosphor-bronze) moving at a speed of 3.5 ft./min. The width of the web formed was 38 inches. The feed to the disintegrator had a moisture content of 50 parts water to 100 parts of fibre to dissipate the heat of disintegrator and also to maintain the correct humidity in the settling chamber. An evenly distributed web of fibres was deposited onto the foraminous member. The resulting web was impregnated as in Example No. 1 with a liquid containing 10% acrylic latex and 4% melamine formaldehyde syrup. The impregnated web was dried as in Example No. 1. The resulting product had the following properties:

| | | |
|---|---|---|
| Basis Weight (g/m²) | | 640 |
| Caliper (mm) | | 2.57 |
| Apparent Specific Gravity (gm/cm³) | | 0.25 |
| Air Permeability (Liters/minute/10sq.cm/10cm Water gauge) | | 45 |
| Pore Size: | Maximum, microns (Bubble Point) | 74 |
| | Mean, microns (Boil Point) | 62 |
| Water Flow Rate (Liters/sq.meter/hr/25 cm.Hg) | | 282,000 |
| Burst (kg/cm²) | Dry | 2.8 |
| (Mullen) | Wet | 1.4 |

The resulting material had good properties for filtration in depth.

EXAMPLE NO. 14

A mixture of bleached kraft 80 parts and high alpha pulp 20 parts was fed to the disintegrator fitted with a perforated screen with slots measuring 1.5 mm wide and 12.7 mm long. The vibra screw feeder had a speed of 5.5 r.p.m. The web was formed at a width of 52 inches with the foraminous receiving member (30 mesh phosphor-bronze) moving at a speed of 4.5 ft/min. The feed to the disintegrator had a moisture content of 70 parts water to 100 parts of fibres to dissipate the heat of disintegrator and also to maintain the correct humidity in the settling chamber. An evenly distributed mixture of fibres was deposited onto the foraminous member. The resulting web was then impregnated by the method of Example 1 with a modified polyacrylate latex of 10% solids content. The binder also had 3% by weight of titanium dioxide pigment in it. The titanium dioxide had been pasted through a ball mill in the conventional manner to ensure complete dispersion. The impregnated web was then dried as in Example 1.

The resulting product had the following properties:

| | | |
|---|---|---|
| Basis Weight (g/m²) | 130 | |
| Caliper (mm) | 0.43 | |
| Apparent Specific Gravity (gm/cm³) | 0.30 | |
| Tensile Strength Machine Direction | 1.35 | (kg/15mm strip with 43% stretch) |
| Tensile Strength Cross Direction | 1.2 | (kg/15mm strip with 44% stretch |
| Tear (Elmendorf) Machine Direction | 107 | gm |
| Tear (Elmendorf) Cross Direction | 160 | gm |

The resulting material was very soft and drapable with good handle and can be used for disposable garments. It had very good opacity. It can be printed, coated with plastics and foam backed like conventional and non-woven textile materials.

This material can be made more absorbent by replacing the bleached kraft part of the furnish by high alpha pulp. The combination of high absorbency and high stretch enables the material to be used in place of textiles as an overlay for polyester mouldings.

The following example was carried out in a similar manner to the previous set of examples but without the curved baffle and sealing roller i.e., a fully enclosed rectangular settling chamber was used. All the excess air was filtered through bag filters to recover the entrained fibre and fillers which were mixed again with fresh fibre and filler for subsequent runs. The material was formed at various widths, the width being controlled by the position of the sides of the chamber and the position of the slides in the suction box. The rate of feed was controlled by the speed of revolution of the Vibra screw feeder. The comments with regard to the moisture content of feed and the squeezing of the impregnator wires as given for the first set of examples as well as the comments regarding the use of the return loop and also pertinent to the following example:

EXAMPLE NO. 15

A mixture of high alpha wood pulp 1 part and decolorising active carbon 2 parts was fed to the disintegrator (fitted with a perforated screen with 2.45mm diameter holes. The web formed was at a width of 41 inches with the foraminous receiving member (30 mesh phosphor-bronze) moving at a speed of 3 ft/min. The feed to the disintegrator had a moisture content of 45 parts water to 100 part of fibre to dissipate the heat of disintegrator and also to maintain the correct humidity in the settling chamber. At the same time a loomstate cotton scrim of 30 × 20 count was run on the foraminous member just before the latter entered the settling chamber so that it passed along the base of the settling chamber carried by and upon the foraminous member. An evenly distributed mixture of fibres and active carbon was deposited onto the scrim. The composite web was then transferred to the impregnator as in Example No. 1 where it was impregnated with a p.v.c. latex of 10% solids content. The impregnated web was then dried as in Example No. 1. The resulting product had the following properties:

| | | |
|---|---|---|
| Basis Weight (g/m²) | | 850 |
| Caliper (mm) | | 2.18 |
| Apparent Specific Gravity (gm/cm³) | | 0.38 |
| Pore Size: | Maximum,microns (Bubble Point) | 30 |
| | Mean,microns (Boil Point) | 14 |
| Water Flow Rate (liters/sq.meter/hr 25 cm.Hg | | 45,000 |
| Wet Burst (kg/cm²) (Mullen) | | 2.8 |
| Active Carbon Content (%) | | 50 |

The resulting product has all the advantages of the materials in Example 1 and 2 for the chemical purification and decolorisation of liquids.

We claim:

1. An apparatus for forming a fibrous web comprising a longitudinally extending foraminous fibre-receiving member, means for moving said member in said longitudinal direction, means defining an expansion chamber disposed above said fibre-receiving member; supply means for supplying a stream of fibres to said expansion chamber, said supply means being of fixed dimensions in both the longitudinal and transverse directions, said supply means being disposed in fixed geometrical relationship with said expansion chamber and initiating the passage of said fibres downwardly through said expansion chamber in downwardly progressing zones of progressively decreasing fibre density; both said expansion chamber and said fibre-receiving member being larger than said supply means in said transverse direction so that the profile of said stream of fibres progressively becomes wider in both said longitudinal and transverse directions as the fibres move downwardly; a curved baffle being disposed in said expansion chamber and projecting a convex surface inwardly and in a direction opposite to the direction of travel of said fibre-receiving member, said baffle being disposed transverse of said direction of travel, means defining a suction chamber disposed beneath said foraminous fibre-receiving member which suction chamber is larger than said supply means in both said longitudinal and transverse directions, and means for reducing the pressure in said suction chamber below that in said expansion chamber for holding the formed web on said fibre-receiving member while permitting expansion of the fibres during their downward passage through said expansion chamber.

* * * * *

UNITED STATES PATENT OFFICE

CERTIFICATE OF CORRECTION

PATENT NO. : 4,004,324

DATED : January 25, 1977

INVENTOR(S) : FRANK BRIDGE ET AL

It is certified that error appears in the above-identified patent and that said Letters Patent are hereby corrected as shown below:

In the heading at line 73 the name of the assignee should be "Associated Paper Industry, Limited".

Signed and Sealed this

*fifth* Day of *July 1977*

[SEAL]

*Attest:*

RUTH C. MASON
*Attesting Officer*

C. MARSHALL DANN
*Commissioner of Patents and Trademarks*